US006012312A

United States Patent [19]

Bezkorow

[11] Patent Number: 6,012,312

[45] Date of Patent: Jan. 11, 2000

[54] DOUBLE BLANK DETECTOR APPARATUS AND METHOD OF OPERATION

[75] Inventor: Andrew J. Bezkorow, Brantford, Canada

[73] Assignee: Budd Canada, Inc., Canada

[21] Appl. No.: 09/152,740

[22] Filed: Sep. 14, 1998

[51] Int. Cl.[7] ..... B21B 33/02

[52] U.S. Cl. ..... 72/4; 72/20.2; 72/21.3; 72/31.1; 72/37; 192/126

[58] Field of Search ..... 72/4, 20.1, 20.2, 72/21.2, 21.3, 31.01, 31.1, 31.12, 37, 375; 192/126, 127, 125 A, 125 R

[56] References Cited

U.S. PATENT DOCUMENTS

| | | | |
|---|---|---|---|
| 4,046,040 | 9/1977 | Bourdo | 192/125 A |
| 4,608,843 | 9/1986 | Grims | 72/4 |
| 4,804,173 | 2/1989 | Pol et al. . | |
| 4,932,823 | 6/1990 | Castor et al. | 72/4 |
| 5,064,043 | 11/1991 | Macdonald | 192/125 A |
| 5,098,078 | 3/1992 | Nakanishi . | |
| 5,269,163 | 12/1993 | Yagi et al. | 72/20.1 |
| 5,331,831 | 7/1994 | Schneider | 72/4 |
| 5,348,286 | 9/1994 | Buck . | |
| 5,349,199 | 9/1994 | Rabjohns et al. . | |
| 5,356,130 | 10/1994 | Infanger . | |
| 5,525,809 | 6/1996 | Bolea . | |
| 5,577,720 | 11/1996 | Laskowski . | |
| 5,662,324 | 9/1997 | Cannaverde et al. . | |
| 5,704,246 | 1/1998 | Krüger . | |

*Primary Examiner*—Joseph J. Hail, III
*Assistant Examiner*—Ed Tolan
*Attorney, Agent, or Firm*—Harness, Dickey & Pierce, P.L.C.

[57] ABSTRACT

A double blank detector apparatus and method of operation determines the condition of when one blank, no blanks or more than two blanks are about to be fed into a press. An indicator bar advances relative to the number of blank sheets of material being detected and interrupts an infra-red light beam when only blank of material has been detected. Under this preferred condition, a signal is produced which allows a press located adjacent to the double blank detector to continue its stamping operation. Alternatively, if either a no blank or a double blank condition is sensed, then the indicator bar advances accordingly, thus not interrupting the infra-red light beam. During this condition, a signal is produced indicative of the situation thus notifying the operator that there is a problem and stopping the press from cycling.

19 Claims, 3 Drawing Sheets

DOUBLE BLANK DETECTOR APPARATUS AND METHOD OF OPERATION

FIELD OF THE INVENTION

This invention relates generally to the handling of stock material during press operations, and more particularly concerns an apparatus and method for making certain that only one blank sheet of material is being fed into a press during each cycle of operation.

BACKGROUND AND SUMMARY OF THE INVENTION

While operating a punch press it is necessary to transfer blank sheets of material into and out of the punch press. Such operations are often done in high speed production facilities. In order to maximize production capabilities of a particular assembly line, loading and unloading the punch press has been automated by using computer controlled robots that are capable of handling stock material. Other systems for feeding a press include a holding bin feed system which has an automatic sheet feeding mechanism that incorporates a device for picking up the top sheet of blank material and advancing the blank sheet to a feed or work table. The feed mechanism then advances the blank sheet to a set of punch press grippers and against the alignment pins within the press. Once the blank sheet is properly located within the press, the press performs its operation and the stamped sheet is removed and the cycle repeats.

One of the problems with the aforementioned conventional automatic sheet feed type mechanisms is that if more than one blank is fed into the press, the press can be damaged, thus resulting in significant down time and repair costs. Further, if the holding bin containing the stock of blank sheets is empty and no blanks are fed into the punch press, then the press would cycle but not produce any finished product because no blank sheet was fed into the press. This results in a waste of time and can contribute to other problems on the assembly line.

Accordingly, it is desirable to provide a method and apparatus for detecting the presence of more than one blank that is to be introduced into a press prior to the press cycling. In such a double blank situation it would be desirable to stop the press from cycling and to notify the press operator of this undesirable condition.

It would also be desirable to provide a method and apparatus for determining whether no blank sheet of material is being advanced to the punch press. Such condition could occur when the supply stack of blanks from the holding bin has been depleted. In such a condition it would be desirable to stop the press from cycling and notify the press operator of this undesirable condition.

According to one aspect of the present invention, a system for detecting blanks that are being fed to a machine is comprised of a first cylinder connected to a frame member and operable to be situated to a first position and to a second position. A second cylinder is connected to a frame member and is operable to be situated to yet another first position and to a second position. A pivoting jaw member is connected to the frame member and to the second cylinder. A fixed jaw is further connected to the frame member and is spaced apart from the pivoting jaw member to create a receiving area for receiving a steel blank. An indicator bar pivots relative to the pivoting jaw member which in turn advances to a position in accordance to the number of blanks positioned between the fixed pivoting jaw. The indicator bar interrupts a light beam generated by an infra-red light system when one blank is detected.

According to another aspect of the present invention, a process of detecting a condition when other than one blank is being fed into a press is comprised of the steps of positioning a first cylinder to a retracted position and a second cylinder to an extended position. A steel blank is advanced to a check position located between a pivoting and fixed jaw. The first cylinder then extends while the second cylinder is retracted. An indicator bar that is pivotally connected to the pivoting jaw is then advanced to a position where it either interrupts a light beam or does not interrupt the light beam. The resulting condition is sensed by a receiver and a signal is transmitted to a control box where the signal is processed. If the light beam signal is interrupted by the indicator bar, a signal is produced allowing the press to continue operating. Alternatively, if the light beam is not interrupted, then a corresponding signal is produced thus stopping the press from cycling and notifying the operator of this condition.

These and other various advantages and aspects of the present invention will become apparent from the following description and claims, in conjunction with the patent drawings.

DETAILED DESCRIPTION OF THE PREFERRED EMBODIMENT

Figure 1:
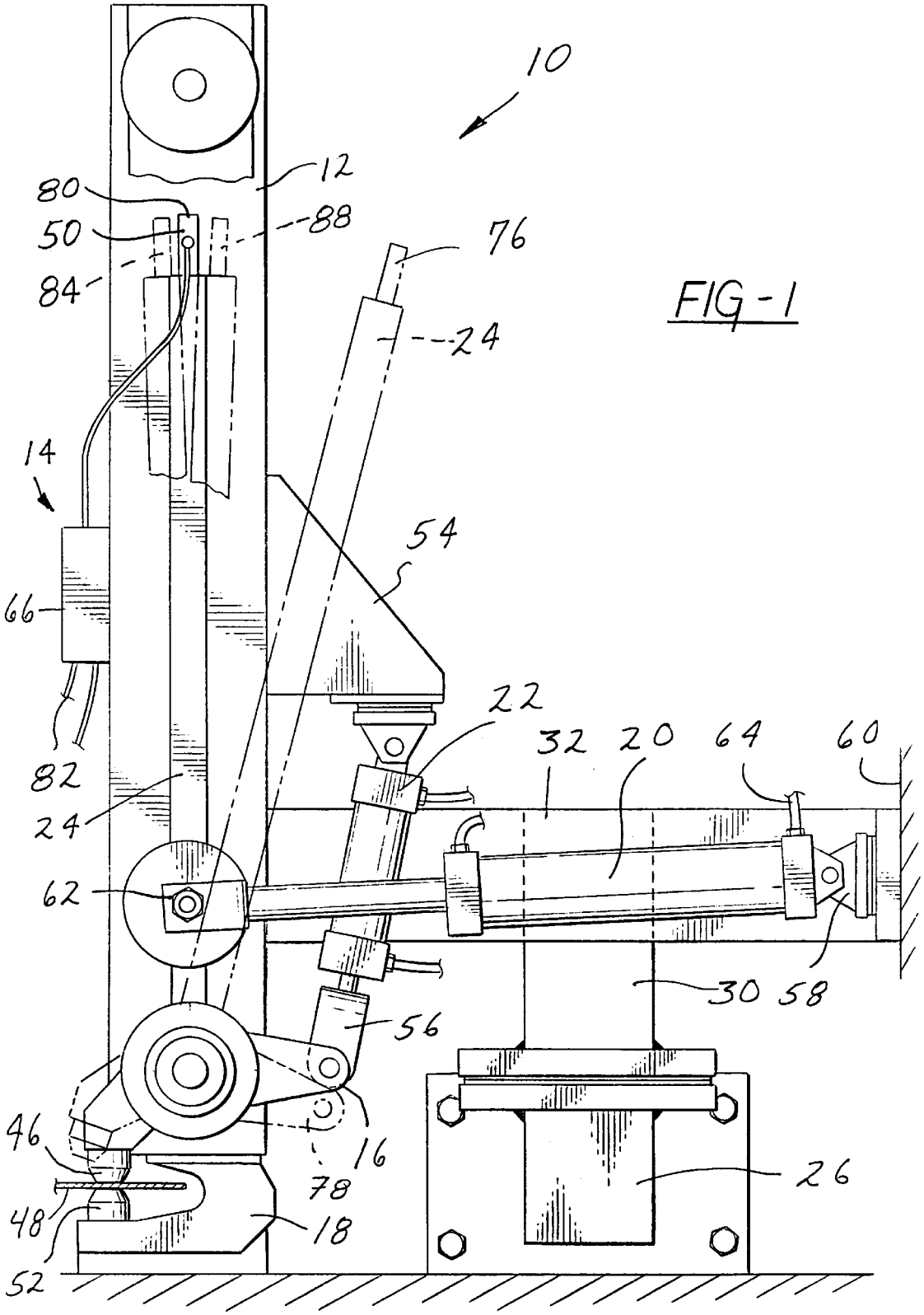
FIG. 1 is a side elavational view of the apparatus for detecting double blanks, where the preferred condition of a single blank being detected is shown by the solid lines, while shown in phantom is the positioning of the indicator bar and pivot jaw during an open position.
Figure 2:
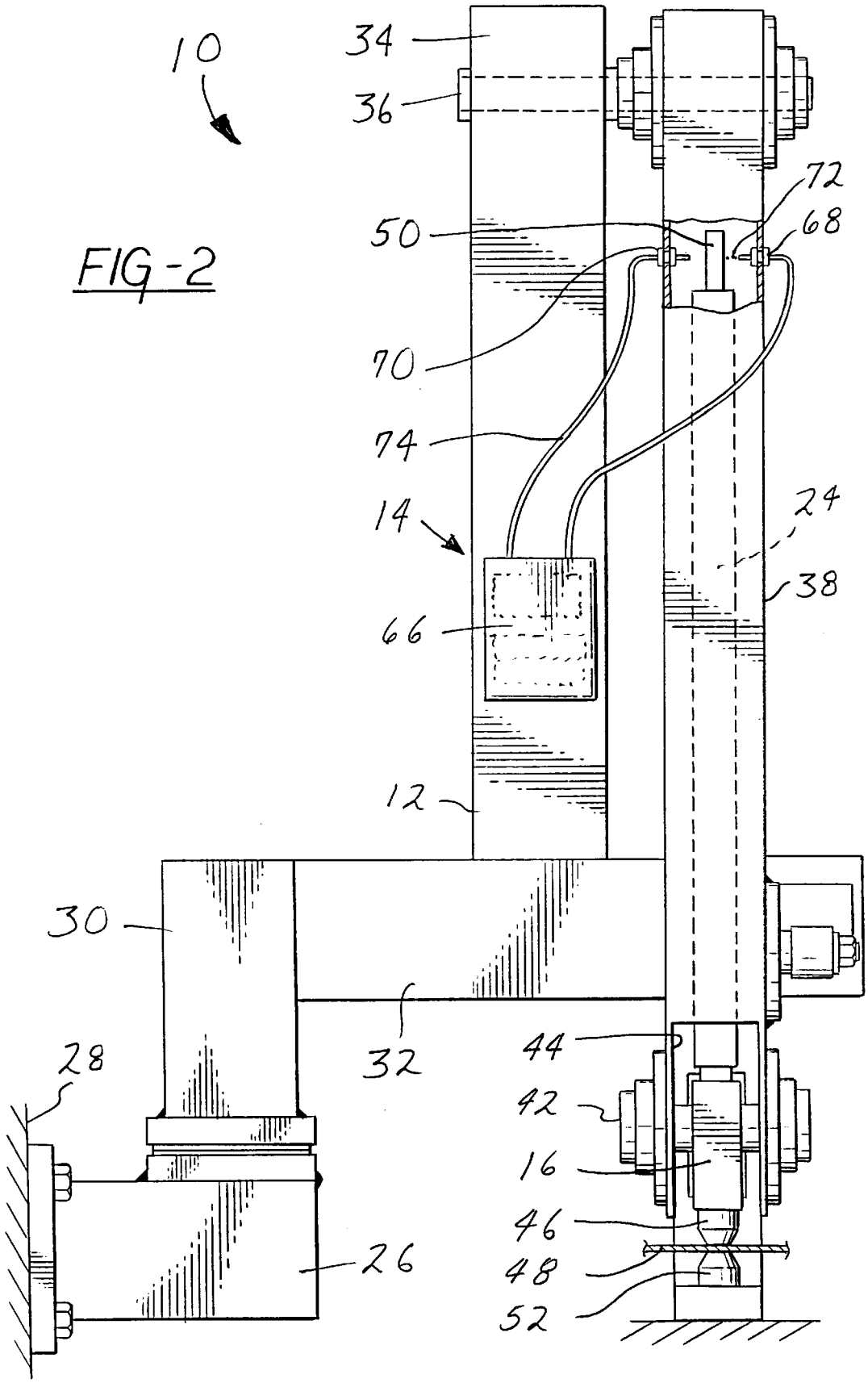
FIG. 2 is an end view of the double blank detector apparatus, showing one blank being detected.

The following description of the preferred is merely exemplary in nature, and is in no way intended to limit the invention, or its application or uses. For discussion purposes, the present invention is shown and discussed in the context of being used with a punch press. It will be appreciated that the present invention may be used in other applications where it is desirable to detect a double blank or a no blank condition.

With reference to the drawings, an apparatus and method for detecting double blanks, one blank, or a no blank condition is shown in the figures. A double blank detector apparatus 10 is comprised of a frame 12 an infra-red light system 14, a pivot jaw 16 and a fixed jaw 18, a first cylinder 20 and a second cylinder 22 and an indicator bar 24. The frame 12 is preferably made of tubular steel that is sufficient in strength to withstand the manufacturing environment to which this apparatus is to operate. The frame 12 includes a first support 26 that is secured to a wall 28 or other rigid structure. A second support 30 extends vertically from and is welded to the first support 26. A third support 32 is welded to and extends horizontally from the second support 30. A fourth support 34 is welded to and extends vertically from the third support 32 and a has a pivot pin 36 journalled thereto at a distal end. The pivot pin 36 extends through and supports an indicator bar frame 38, which in turn pivots about a central axis of the pivot pin 36. The indicator bar frame 38 is preferably made of hollow rectangular structural steel construction and allows the indicator bar 24 to advance to an open position as illustrated in phantom in FIG. 1.

A second pivot pin 42 is journalled to the lower end of the indicator bar frame 38 and is received by a bore within the pivot jaw 16. The lower end of the indicator bar frame 38 further has a notched out region 44 which allows the pivot jaw 16 to articulate freely without interfering with the frame 38. The lower end of the pivot jaw 16 preferably has a hardened carbide tip 46 for engaging blank sheets of material 48. The carbide tip insures repeatability and a low squeezing force further insures that the steel blanks are not damaged. The indicator bar 24 is preferably made of steel or other sufficiently rigid material to withstand long term operation in a manufacturing environment. The lower end of the indicator bar 24 is secured to an upper surface of the pivot jaw 16 preferably by welding. The upper end of the indicator bar 24 has a reduced area or neck 50 that is operable to block the light beam 72 that is emitted from the infra-red light system 14. Offset a predetermined distance from the lower end of the indicator bar frame 38 is a fixed jaw 18. Another rubberized tip 52 is secured to the fixed jaw 18. In FIG. 1 the tips 46 and 52 are shown offset from one another in a single blank condition position. This is the position when a single blank 48 is detected during the checking operation.

The pivot jaw cylinder 22 is secured on one end by a gusset 54 that is in turn fixed to the frame 12. The piston end of the pivot jaw cylinder 22 includes a knuckle 56 that is pivotally connected to one end of the pivot jaw 16. The advance cylinder 20 is secured by mounting bracket 58 to a wall 60. The piston end of the advance cylinder 20 has a knuckle 62 pivotally connected to the indicator bar 24. The advance cylinder 20 is operable to move to an extended position as shown in FIG. 1 whereby the number of blanks 48 are then detected. The advance cylinder 20 is further operable to be positioned to a retracted position whereby the indicator bar, as shown in phantom in FIG. 1, is moved to an open position thereby allowing a blank 48 to be inserted into the checking area of the apparatus 10. The advance cylinder 20 and pivot jaw cylinder 22 are preferably double-acting pneumatic cylinders which are supplied with air through lines 64.

The infra-red light system 14 includes a light source and control box 66, a transmitter 68 secured to frame 38, and a receiver 70 also secured to the frame 38. The control box 66 preferably contains an infra-red light producing device, a signal processor for distinguishing when the receiver 70 is or is not receiving a signal and a signal generating device operable to transmit a signal to a PLC that is indicative of whether or not the receiver 70 has received a beam of light 72. The transmitter 68 is capable of directing the light beam 72 towards the receiver which in turn transmits a signal along wire 74 back to the control box 66. The transmitter 68 and receiver 70 are positioned so as to generate a light beam 72 along a path capable of being interrupted by the neck 50 of the indicator bar. The transmitter 68 and receiver 70 are secured to the frame 38 via conventional methods.

The method of operating the present invention which is capable of detecting a double blank condition, a single blank condition or a no blank condition will now be presented. Initially, the indicator bar 24 is moved to the open position 76 as illustrated in FIG. 1. This allows the pivot jaw 16 to articulate in a clock-wise direction thus allowing a steel blank 48 to be positioned between the jaws which is the check area. The indicator bar 24 is moved to the open position 76 by retracting the advance cylinder 20 and extending the piston of the pivot jaw cylinder jaw 22 such that the pivot jaw 16 articulates to an open position 78 as shown in phantom.

Next, the double blank detector apparatus 10 is ready to sample the quantity of blanks 48 that have been either fed into the press or are about to be fed into a press. This step is accomplished by the advance cylinder 20 extending its piston while the pivot jaw cylinder 22 retracting its piston. This action causes the indicator bar 24 to articulate to an upward position as the pivot jaw 16 rotates in a counter-clockwise direction. If a single blank 48 is detected as illustrated in FIG. 1, then the indicator bar 24 is located to a single blank position 80. This condition causes the light beam 50 to be interrupted which in turn causes the receiver 70 to send a signal to the control box 66 indicative of a single blank being fed into the press. This is the preferred condition as it is desirable to only allow one blank to be fed into a press at a time. The control box 66 in turn sends a signal via wires 82 to a PLC having a control screen thus allowing the operator to be advised that the operating conditions are proper.

Alternatively, if pivot jaw 16 advances to a position whereby the tips 46 and 52 touch, then a no blank condition has been detected. When this condition occurs, the indicator bar 24 advances to the no blank condition position 84 as shown by the solid lines in FIG. 3. The no blank condition can occur when the supply bin has been depleted or if the machinery supplying the blank stock 48 to the blank detector 10 is not properly functioning. During the no blank condition, the light beam 50 is received by receiver 70 and a signal is transferred to control box 66 indicative of a condition other than a single blank being detected. During this situation, the control box 66 sends a stop signal via line 82 to a computer screen notifying the operator that there is a problem. Further, it is preferred that the control box 66 send a signal to the press to prevent the press from cycling.

Figure 3:
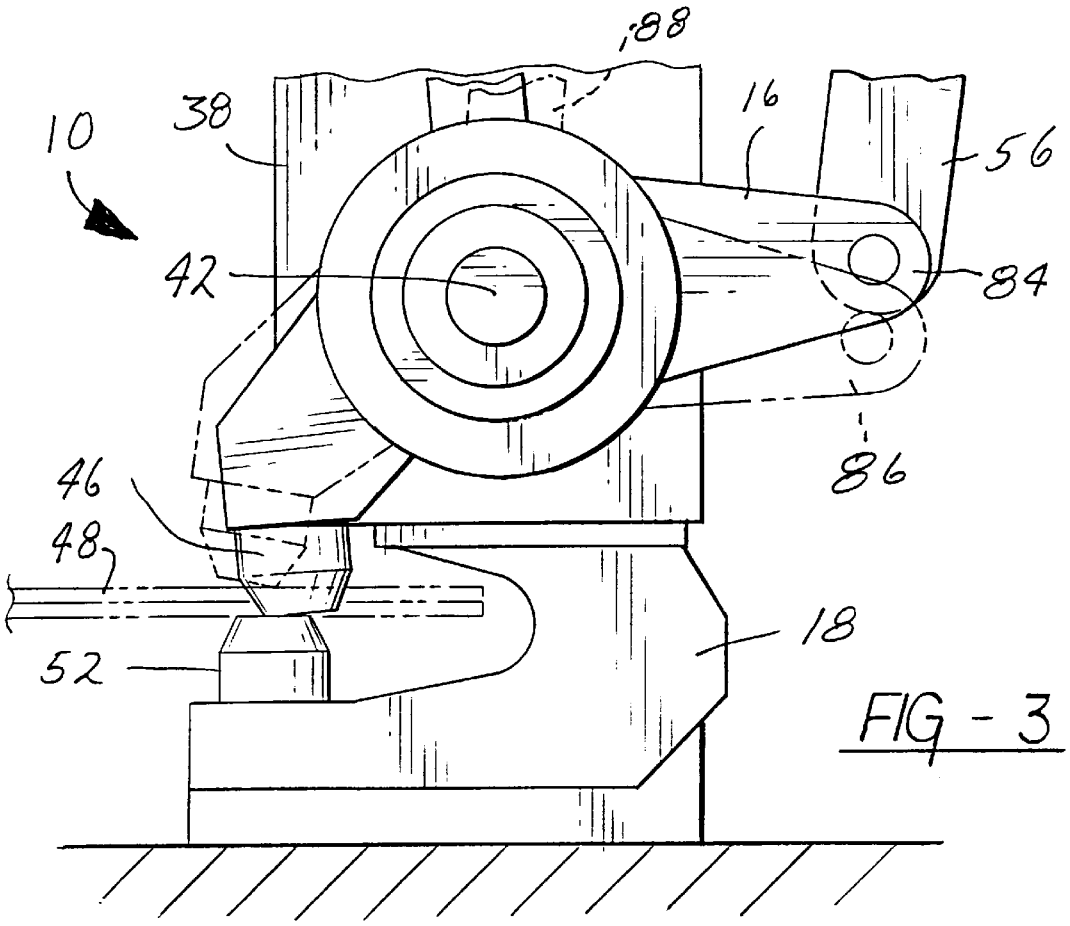
FIG. 3 is an enlarged side elevational view of the present invention illustrating a no blank position condition shown by the solid lines and a double blank position shown in phantom.

Yet another condition to be sensed is the situation where two or more blanks are present. This condition is illustrated in FIG. 3 in phantom whereby two steel blanks 48 have been advanced to the check area thus causing the pivot jaw 16 to articulate to a double blank position 86 which in turn causes the indicator bar 24 to advance to double blank position 88 (FIG. 1). During a double blank condition, the indicator bar 24 does not interrupt the light beam 72. Accordingly, receiver 70 transmits a signal to control box 66 indicative of a condition where something other than one blank has been sensed. A signal is then sent to the computer screen thus advising the operator of this improper condition. Further, a signal is sent to the press thus stopping it from further cycling until the condition has been remedied. Once the problem has been cured, the advance cylinder 20 retracts to the open position 76 and the pivot jaw cylinder 22 extends its position to the open position 78. The cycle can then be repeated.

It should be understood that an unlimited number of configurations of the present invention can be realized. The foregoing discussion discloses and describes mere exemplary embodiments of the present invention. One skilled in the art will readily recognize from the discussion and from the accompanying drawings and claims that changes and modifications can be made without departing from the spirit and scope of the invention, as defined in the following claims.

What is claimed is:

1. A method of operating a double blank detecting machine for use in connection with operating a press comprising the steps of:

a) positioning a blank piece of material between a set of jaws;

b) closing the jaws and advancing an articulating arm that is connected to one of the jaws to a position proportionate to a thickness of the material;

c) emitting a beam of light;

d) interrupting the beam of light with the articulating arm and producing a first signal if one blank piece of material is positioned between the jaws;

e) not interrupting the light beam with the arm and producing a second signal if something other than one blank is positioned between the jaws; and f) stopping the double blank detecting machine if the second signal is produced.

2. The method of operating the double blank detecting machine as claimed in claim 1 wherein the step of interrupting the light beam includes moving cylinders that are in turn connected to a pivoting arm and positioning the pivoting arm in line with the beam.

3. The method of operating a double blank detecting machine as claimed in claim 1 wherein the step of emitting light includes providing a transmitter, a receiver and a controller, and continuously generating a beam of light until a predetermined condition occurs.

4. The method of operating a double blank detecting machine as claimed in claim 1 wherein the step of closing the jaws, includes extending a first cylinder and retracting a second cylinder until the set of jaws engage the blank piece of material.

5. The method of operating a double blank detecting machine as claimed in claim 1 further comprising the step of stopping the press if the second signal is produced.

6. A process of preventing a press from operating when a certain condition occurs comprising the steps of:

providing a first cylinder, a second cylinder, a fixed jaw, and a pivoting jaw connected to the second cylinder;

positioning the first cylinder to a retracted position;

positioning the second cylinder to an extended position causing the pivoting jaw to move away from the fixed jaw;

inserting a blank piece of material between the fixed jaw and the pivoting jaw;

extending the first cylinder to an extended position;

extending the second cylinder to a retracted position to cause the pivoting jaw to engage the blank;

emitting a beam of light and generating a first signal if a condition other than one blank is detected;

emitting a beam of light and generating a second signal if a single blank condition is detected; and deactivating the cylinders if the first signal is detected.

7. The process as described in claim 6 wherein the cylinders continue to operate if the second signal is detected.

8. The process as described in claim 6 wherein the step of generating a first signal includes sending a warning signal to a computer screen to notify an operator that the press should or has stopped.

9. The process as described in claim 6 wherein the second signal stops the press from further cycling.

10. The process as described in claim 6 wherein the step of generating a first signal includes deactivating the cylinder so that a cycle of operation is stopped.

11. A system for detecting blanks being fed to a machine comprising:

a first cylinder connected to a frame member and operable to be situated to a first position and to a second position;

a second cylinder connected to a frame member and operable to be situated to a first position and to a second position;

a jaw member pivotally connected to the frame member and to the second cylinder;

a fixed jaw connected to the frame member and spaced apart from the jaw member;

a light system operable to produce a signal indicative of the number of blanks to be fed into a machine; and an indicator bar connected to the jaw member, the indicator bar being operable to interrupt a light beam that is generated by the light system.

12. The system for detecting blanks as claimed in claim 11 wherein the light system includes a transmitter, a receiver and a control box that is operable to generate an infra-red beam of light.

13. The system for detecting blanks as claimed in claim 11 wherein the jaw member has a bumper that engages the blank.

14. The system for detecting blanks as claimed in claim 11 wherein the light system includes a controller that is operable to transmit a light beam and produce a signal indicative of the number of blank pieces of material that are inserted between the jaw member and the fixed jaw.

15. A double blank detector apparatus for use in connection with operating a press, the apparatus comprising:

a frame having structural components that are secured to a feed table;

a pair of cylinders secured to the frame;

an articulating member pivotally connected to one of the cylinders;

a fixed member spaced apart from the articulating member, together the articulating member and the fixed member define a checking zone;

a light source connected to the frame that is operable to generate a beam of light; and an arm connected to the articulating member and operable to interrupt the beam of light during a first mode of operating the apparatus, and the arm being operable to not interrupt the beam of light during a second mode of operating the apparatus.

16. The apparatus as claimed in claim 15 wherein the light source includes a controller, a transmitter and a receiver located near to the arm.

17. The apparatus as claimed in claim 16 wherein the controller includes a source for producing an infra-red beam of light and a process operable to distinguish when the receiver receives a beam of light or does not receive a beam of light.

18. The apparatus as claimed in claim 15 wherein the arm is connected to one of the cylinders and locatable to a plurality of positions.

19. The apparatus as claimed in claim 15 further comprising a blank piece of material positionable within the checking zone.

* * * * *